US007020909B2

(12) United States Patent
Ciotic

(10) Patent No.: US 7,020,909 B2
(45) **Date of Patent: *Apr. 4, 2006**

(54) PORTABLE VENTING COMMODE

(76) Inventor: Egor Ciotic, 6048 Sundale Way #77, Fair Oaks, CA (US) 95628

( * ) Notice: Subject to any disclaimer, the term of this patent is extended or adjusted under 35 U.S.C. 154(b) by 0 days.

This patent is subject to a terminal disclaimer.

(21) Appl. No.: 10/874,973

(22) Filed: Jun. 23, 2004

(65) Prior Publication Data

US 2004/0231035 A1 Nov. 25, 2004

Related U.S. Application Data

(62) Division of application No. 09/715,456, filed on Nov. 17, 2000, now Pat. No. 6,779,204.

(51) Int. Cl.
*A47K 11/06* (2006.01)

(52) U.S. Cl. ..... 4/482; 4/213; 4/217

(58) Field of Classification Search ..... 4/213, 4/217, 254, 477, 482, 472
See application file for complete search history.

(56) References Cited

U.S. PATENT DOCUMENTS

| | | | | |
|---|---|---|---|---|
| 3,357,029 | A * | 12/1967 | Schulz | 4/217 |
| 3,585,651 | A * | 6/1971 | Neale | 4/348 |
| 4,175,293 | A * | 11/1979 | Stephens et al. | 4/209 R |
| 5,522,093 | A * | 6/1996 | Schaffer | 4/213 |
| 5,671,484 | A * | 9/1997 | Lee, III | 4/213 |
| 6,055,677 | A * | 5/2000 | McKinley | 4/217 |
| 6,779,204 | B1 * | 8/2004 | Ciotic | 4/482 |

* cited by examiner

*Primary Examiner*—Justine R. Yu
*Assistant Examiner*—Huyen Le
(74) *Attorney, Agent, or Firm*—Mark C. Jacobs

(57) ABSTRACT

A portable self-contained vented commode is described. The stand alone apparatus includes a frame, a pivoting toilet seat, and an aligned removable collection container capable of being dumped post receipt of human waste, which container is disposed beneath the toilet seat. A seal is attached to the seat bottom to cooperate with the container for vapor retention. A flexible hose with a DC powered fan thereon is attached to the frame for collection of vapors from the container and the disposal thereof, by creating a positive pressure to expel the vapors to a distant location relative to the frame, through a vent.

16 Claims, 3 Drawing Sheets

PORTABLE VENTING COMMODE

This is a Divisional of application Ser. No. 09/715,456, filed Nov. 17, 2000, now U.S. Pat. No. 6,779,204.

This application is related to a prior patent application, now pending, Ser. No. 09/685,411 filed on Oct. 10, 2000 entitled "Ventilation System for Toilets" by the same inventor.

BACKGROUND OF THE INVENTION

1. Field of the Invention

The present invention, in general relates to portable toilets and, more particularly, to devices that vent odors from portable toilets.

Elderly and infirm people need assistance using a toilet. A portable toilet, hereinafter referred to simply as a "commode" is used for that purpose.

In use the commode may be placed proximate a bed or some other area where the person having need thereof is disposed.

A container that is included and is detachably-attached to the commode. During use, fecal matter and urine are normally deposited into a container along with toilet tissue. The container resembles a pail or bucket in appearance and has a handle and it is detachably-attachable to the commode. A small amount of water is normally placed in the bottom of the container prior to using the commode.

Fecal matter that settles under the water is covered by the water and produces less odor than it would were there no water in the container. After use, the container is later removed from the commode by a caregiver who dumps the contents of the container into a conventional type of a flush-toilet and flushes the fecal matter, tissue, water, and urine away. The interior of the container is cleaned as needed and returned back to the commode.

As is common with bowel movements, a small amount of fecal matter typically is deposited along the inside surfaces of the container. The water may not cover all of the feces either. Urine mixes with the water and produces unpleasant odors as well.

Consequently, the commode will begin to develop an unpleasant (i.e., foul) smell after use. If there is an extended time until the caregiver can empty and clean the container, this unpleasant odor is experienced by those having to remain in proximity to the commode.

This includes, as mentioned hereinabove, the elderly and the infirm. Those suffering or recovering from all manner of maladies may also require the use of a commode. For example, someone who has broken a leg may be confined to a limited area for a period of time and may require the use of a commode.

Clearly, the odors that arise from the use of a commode are unpleasant. When company visits, no person can feel comfortable after having just had a bowel movement in a commode that is disposed very close, perhaps even next to, the guests. The fear of offending the guests with unpleasant odors will weigh on the person's mind who has just used the commode.

Certain types of commodes also permit their placement directly over the top portion of a conventional "flush-type" toilet. Certain of these types of commodes may also function as a walker that the person can use to provide assistance as they walk to the bathroom.

This general type of commode does not include the container. In use, it is placed over the flush-type toilet after first lifting the cover and, usually, the toilet seat of the flush-type toilet. Urine and fecal matter are deposited during use into the bowl of the flush-type toilet.

The raised sides of the commode allow the person that is using it to sit down and raise themselves up after use, whereas they might not be able to do so with a conventional type of a flush-toilet. Some people leave this type of a commode straddled over the flush-type toilet at all times.

While the odors emanating from this type of a commode are generally less severe than emanating from the stand-alone types of commodes (because the waste matter is soon flushed away), there are still odors produced while it is being used and many of these odors linger in the bathroom for some time.

Accordingly there exists today a need for a portable venting commode that lessens the amount of odor that is produced.

Clearly, such an apparatus would be a useful and desirable device.

2. Description of Prior Art

Commodes are, in general, known. However, the known types of devices are not believed to anticipate the instant invention. While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

The above referenced pending patent application, Ser. No. 09/685,411 filed on Oct. 10, 2000 by the present inventor, while different from the instant invention, includes information that may be helpful in understanding the benefits and advantages of the instant invention and it is incorporated by reference herein.

OBJECTS AND SUMMARY OF THE INVENTION

It is an object of the present invention to provide a portable venting commode that lessens odor.

It is also an important object of the invention to provide a portable venting commode that is adaptable for installation of the venting portion in a given area while still being portable.

Another object of the invention is to provide a portable venting commode that is adaptable to be powered by domestic AC voltage and current.

Still another object of the invention is to provide a portable venting commode that is adaptable to be powered by a battery.

Still yet another object of the invention is to provide a portable venting commode that can be placed over an existing flush-type of toilet.

Yet another important object of the invention is to provide a portable venting commode that includes its own container to accumulate human waste.

Still yet another important object of the invention is to provide a portable venting commode that includes a device to adjust it for use with different types of toilets.

Briefly, a portable venting commode of the type that is placed over a conventional flush-type of toilet that is constructed in accordance with the principles of the present invention has a toilet seat and straight chute attached to a portable frame of the commode. The toilet seat includes an opening for conducting the vapors disposed under the toilet seat through a flexible hose to a distal location where they are expelled. A brushless DC motor powered fan provides either suction or positive air pressure to conduct the vapors through the flexible hose. A modified chute is disclosed and it includes a tapered cone-like profile. A flexible ring fits over the exterior of the modified chute and provides a seal intermediate the modified chute and a conventional toilet seat. The modified chute includes a hose connection for directly attaching the flexible hose thereto. A modified type of a portable venting commode that is intended for independent use (not for placement over the conventional flush-type of toilet) includes a frame structure that supports a modified toilet seat that is adapted to pivot over a removable container that collects human waste matter. The modified toilet seat includes a container seal. A modified vent is provided to conduct vapors away from the container area. According to a preferred embodiment, a brushless DC motor is attached to the frame structure. The flexible hose is attached to the outlet side of the DC motor and is placed at a distal location where the vapors are discharged under positive pressure. According to an alternative embodiment, the motor is placed distally and negative pressure (suction) is used to conduct the vapors from the modified portable venting commode.

DETAILED DESCRIPTION OF THE INVENTION

Figure 1:
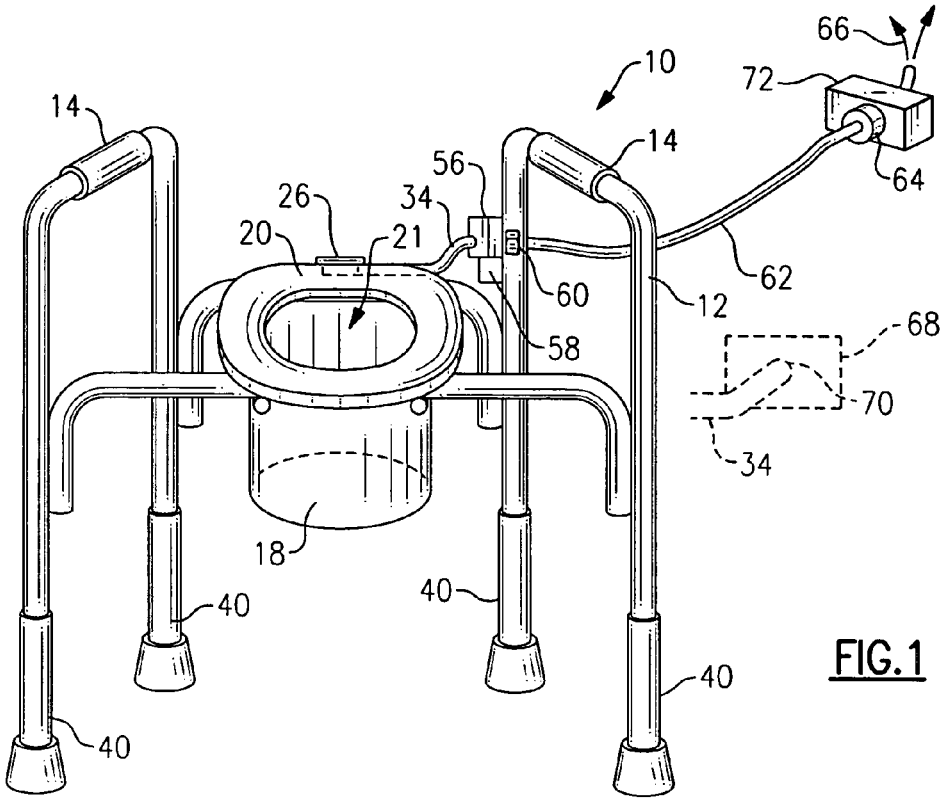
FIG. 1 is a view in perspective of a portable venting commode that is placed over a conventional type of flush-toilet.

Referring to all of the drawings and in particular to FIG. 1 is shown, a portable venting commode, identified in general by the reference numeral 10.

The commode 10 is intended to be placed over a conventional flush-type toilet (not shown), of the type that are well known devices which are permanently installed in bathrooms in homes everywhere.

It includes a frame structure 12 with handles 14 to use in carrying it. It can double as a walker and help a person reach the conventional flush-toilet in the bathroom.

When reaching the conventional flush-toilet, the conventional toilet cover (not shown) is raised and a conventional toilet seat (see reference numeral 16 shown in dashed lines in FIG. 4) that is attached to the conventional flush-toilet is lowered. The commode 10 is then placed over the flush-toilet so a chute 18 passes through an opening provided in the conventional toilet seat 16.

The chute 18 is cylindrical in shape and is open at both ends thereof. It is attached along a first end to a toilet seat 20. The toilet seat 20 includes a center opening 21 and it is attached to the frame structure 12 of the commode 10.

Figure 2:
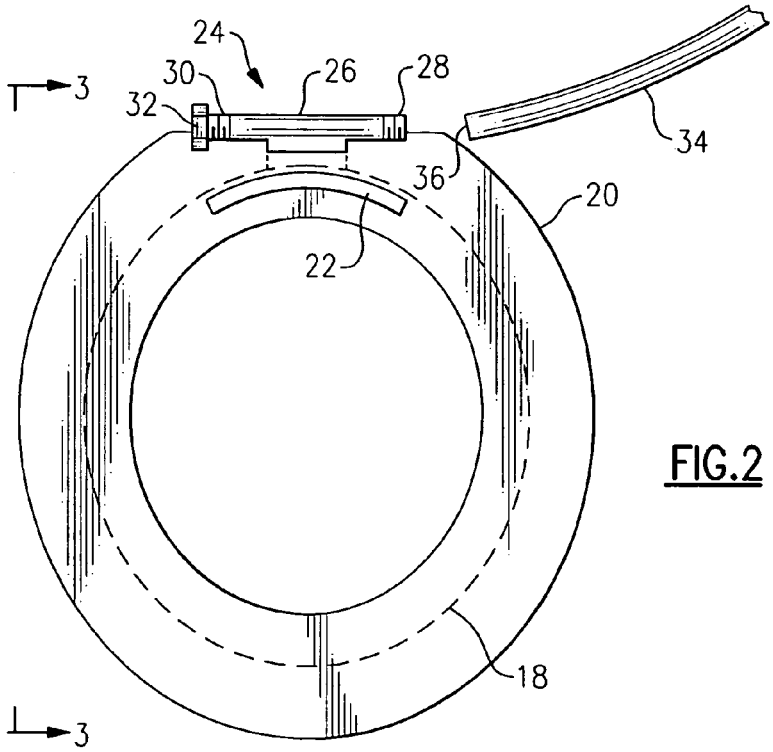
FIG. 2 is a plan view of the bottom of the toilet seat portion of the portable venting commode of FIG. 1.

Referring now also to FIG. 2, the chute 18 is omitted from the view to better reveal details of the toilet seat 20. Its general location (where it is attached) is shown by a dashed circle and by the reference numeral "18".

Within the space encircled by the chute 18, an opening 22 is formed through the rear of the seat 20 and it extends in the seat 20 to a rear vent assembly, identified in general by the reference numeral 24.

The rear vent assembly 24 includes a "T" fitting 26 and it can be used to exhaust vapors from the space inside the chute 18 (when the commode 10 is disposed over the conventional type of a toilet) to an exterior location, as is described in greater detail hereinafter.

The T fitting 26 includes a first discharge opening 28 and an opposite second discharge opening 30. The second opening 30 includes a removable plug 32. The removable plug 30 prevents air from entering the second discharge opening 30 or vapors from exiting at that location. The first and second discharge openings 28, 30 include threaded ends to facilitate connection thereto of a vent hose 34, partially shown in FIG. 2.

If it is preferable to connect the vent hose 34 to the second discharge opening 30 instead of the first 28, the plug 32 is removed from the second opening 30, and a first end 36 of the vent hose 34 is attached to the T fitting 26 at the second opening 30. The plug 32 is then applied to the first opening 28 to seal it instead.

Figure 3:
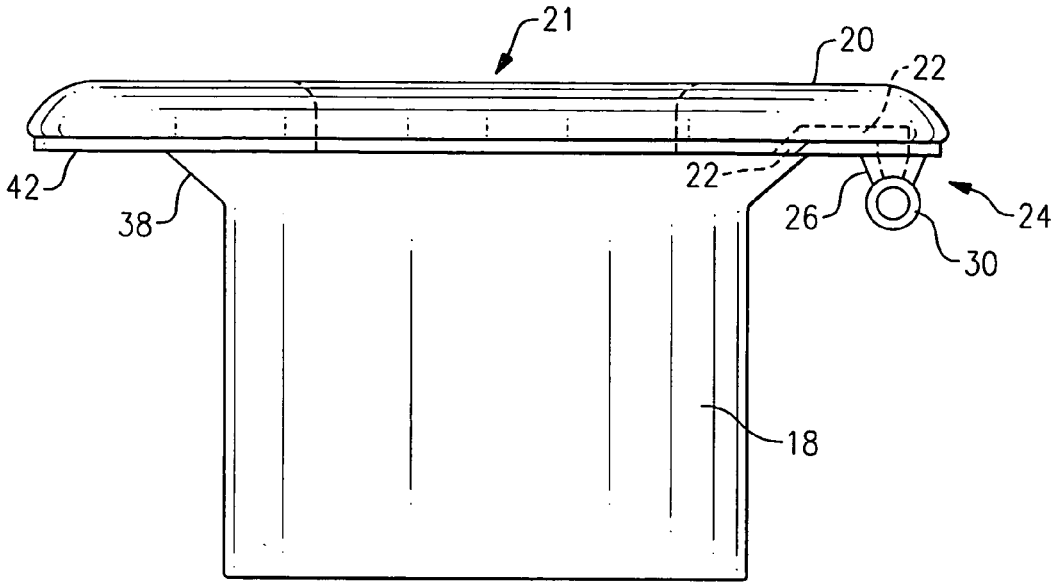
FIG. 3 is a view as shown in FIG. 2 as seen along the lines 3—3 therein.

Referring now also to FIG. 3, the chute 18 includes an upper taper 38, as necessary to ensure that it fully covers (i.e., encircles) the opening 22 in the seat 20.

The rest of the chute 18 is straight so that when it is placed inside the conventional toilet seat 16, the outer diameter of the chute 18 forms an effective seal with the inside diameter of the opening provided in the conventional toilet seat 16.

As the height of legs 40 of the frame structure 12 can be adjusted to suit the user (not shown), it is not possible to know the exact depth that the chute 18 will penetrate the opening in the conventional toilet seat 16.

Accordingly, the straight sides of the chute 18 ensure an effective fit with the opening in the conventional toilet seat 16 regardless of the relative height between the two.

If desired, an additional layer 42 is added under the seat 20 to cover the opening 22 as it extends toward the rear vent assembly 24. The additional layer 42 can also be formed integral with the chute 18, if desired.

Figure 4:
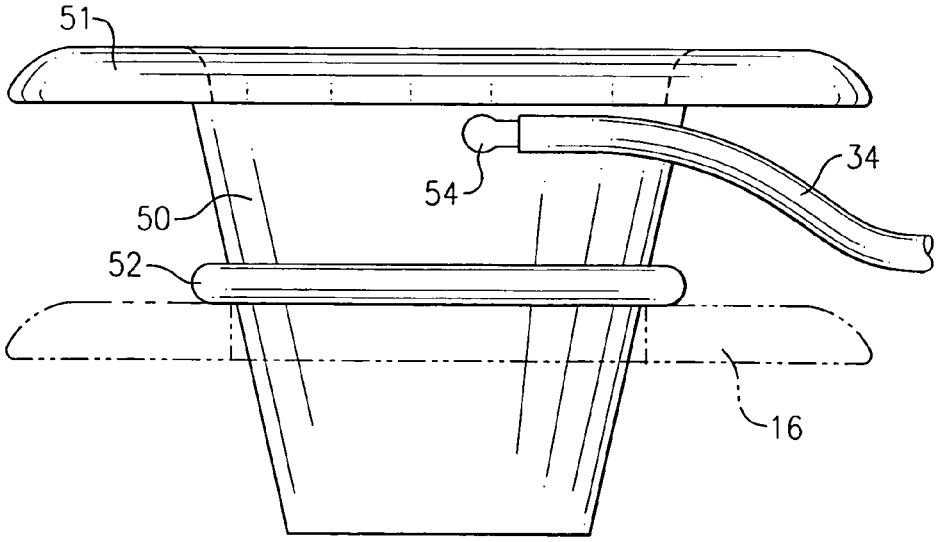
FIG. 4 is a side view of a modified type of chute that includes a tapered shape.

Referring now to FIG. 4, a modified chute 50 is attached to a modified seat 51 that includes a tapered cone-like profile. The modified seat 51 does not include the rear opening 22. The modified seat 51 is similarly attached to the frame structure 12 in place of the seat 20 and chute 18, as described hereinabove.

A flexible ring 52 fits over the exterior of the modified chute 50 and it provides a seal intermediate the modified chute 50 and the conventional toilet seat 16, regardless of how the legs 40 of the commode 10 are adjusted.

The flexible ring 52 can expand or contract as desired so that it can be urged up or down over the modified chute 50 along its longitudinal length.

The modified chute 50 includes an elbow fitting 54 that allows for connection of the vent hose 34 thereto.

Referring again to FIG. 1, a DC brushless low power motor/fan assembly 56 is attached to the frame structure 12. A second end of the vent hose 34 is attached thereto.

A battery pack 58 is attached to the frame structure 12 and it supplies the electrical energy to run the fan assembly 56.

A switch 60 is used to turn the fan assembly 56 on and off, as desired. The switch 60 may be a mechanical switch such as a toggle switch or it can be a motion detector, such as an infrared or other type of motion (or presence) detector that scans the area over the seat 20 and turns the fan assembly 56 on while someone is disposed on the seat 20 and possibly for a limited time thereafter, and then shuts it off.

A second flexible vent hose 62 is attached to the fan assembly 56 at a discharge location thereof and is used to conduct vapors to a location away from the commode 10 where the odor of the vapors will not offend.

A preferred way to accomplish this is to provide a discharge assembly 64 through an exterior wall of the structure and attach the second hose 62 thereto. Arrows 66 indicate the vapors being discharged away from the commode 10.

The second hose 62 can be any preferred length.

Another preferred way is to eliminate the second hose 62 and to interface to the venting system, identified by the reference numeral 68 and shown in dashed lines. The system 68 is described in greater detail in pending patent application Ser. No. 09/685,411 filed on Oct. 10, 2000 by the same inventor.

When the system 68 is used, the first vent hose 34 is merely connected to a port 70 that is provided in the system 68 for that purpose. This connection is shown in FIG. 1 in dashed lines.

The vapors are then sucked out (i.e., by a partial vacuum) by the system 68 motor (not shown) that is distally located. The vapors enter into the port 70 where they are conducted through system piping (not shown) to the system 68 motor for discharge in accordance with the installation of the system 68.

If desired, the system 68 need not be used. An alternative way to use the portable venting commode 10 is to attach a remote motor 72 that is shown in dashed lines surrounding the discharge assembly 64. The remote motor 72 may be installed in the exterior wall or it may be located outside. It is powered by a DC power supply that converts household 120 VAC power into DC to power the DC brushless remote motor 72.

All of the preferred embodiments rely upon the use of some sort of a DC brushless motor attached to a fan so as to eliminate sparks from arising when the motor turns on or off that could potentially ignite the vapors.

Also, these types of motors consume very little electrical energy. Their low power consumption makes them suitable even for continuous duty operation (i.e., being left on all the time) as well as being powered by the battery pack 58.

Finally, it is noted that the seat 20 and the modified seat 51 are rigidly attached to the frame structure 12 of the commode 10, and therefore, do not move in relation thereto.

Figure 5:
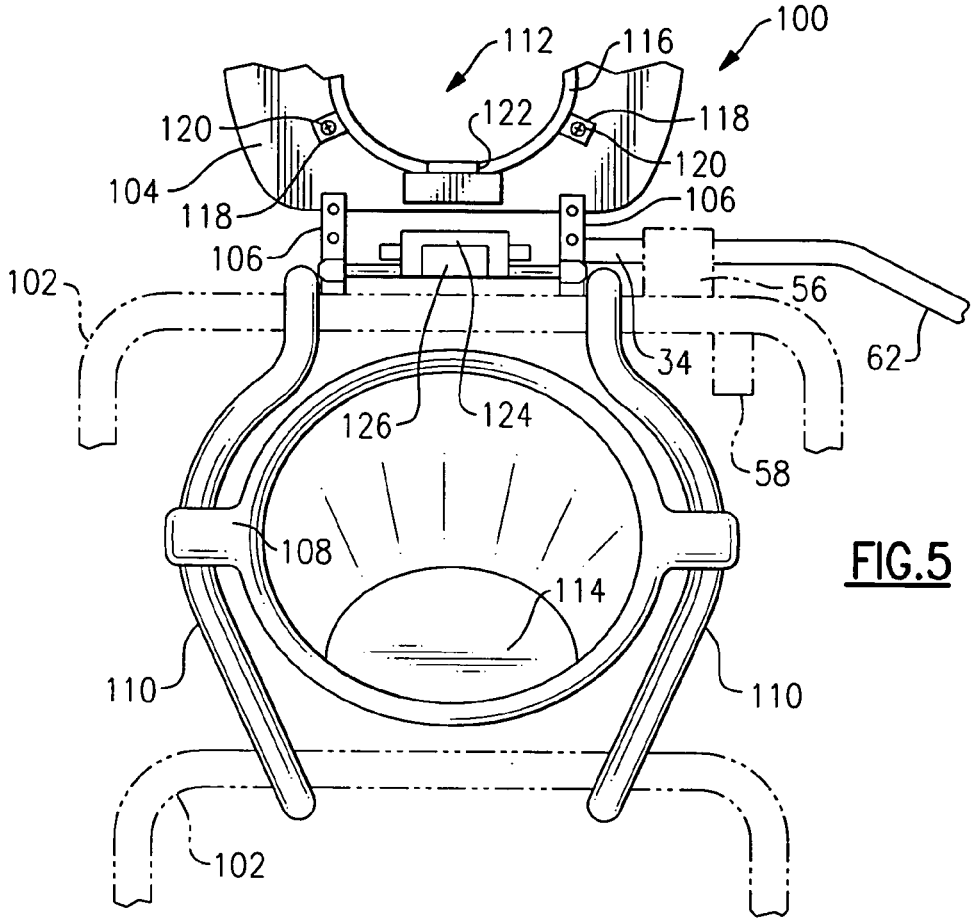
FIG. 5 is a view in perspective of a portion of a modified type of a portable venting commode that is independently used.

Referring now to FIG. 5, when the user is unable to travel to the bathroom and therefore is unable to use the commode 10, a solution that is disposed nearer to the user must be provided.

For this purpose, a modified type of a portable venting commode, identified in general by the reference numeral 100, that is intended for independent use (not for placement over the conventional flush-type of toilet) is provided.

The modified commode 100 includes a modified frame structure 102 (shown partially in dashed lines) that supports a modified toilet seat 104.

Only a portion of the modified toilet seat 104 is shown. The unseen remainder is consistent with other types of toilet seats except for the component parts of the invention and the component parts of the instant invention merely continue as shown so as to extend and to encircle the area that is missing from the view in the FIG. 5 drawing.

The modified toilet seat 104 includes hinges 106 and it is adapted to pivot about an axis over a removable container 108 that is used to collect human waste matter therein.

The modified frame structure 102 includes a pair of rails 110 that are used to support and to properly align the container 108 under a toilet seat opening 112 when the modified toilet seat 104 is disposed in a lower position (i.e., over the container 108).

The container 108 resembles a pail and it includes a bottom 114 that can contain fluids and waste matter therein. In normal use, a small quantity of water is placed in the container prior to defecation by the user.

The modified toilet seat 104 includes a container seal 116 that is attached to the bottom thereof by brackets 118 and screws 120. The container seal 116 takes up any space intermediate the bottom of the modified toilet seat 104 and the top of the container 108 when the modified toilet seat 104 is disposed in the lower position.

The container seal 116 includes a seal opening 122 in the rear thereof. A modified rear vent assembly 124 is disposed to the rear of the modified frame structure 102. The modified rear vent assembly 124 includes a frontal opening 126 that aligns with and abuts the seal opening 122 when the modified toilet seat 104 is disposed in the lower position.

The modified rear vent assembly 124 is similar to the vent assembly 24 as was described hereinabove for use with the commode 10. Accordingly, the vent hose 34 is shown attached to the motor/fan assembly 56 proximate the battery pack 58. The second flexible vent hose 62 is shown attached to the fan assembly 56.

Any of the configurations involving location of the motor fan assembly 56, discharge of vapors, and use of the system 68, as described hereinabove for use with the commode 10, apply also for use with the modified commode 100.

If the remote motor 72 is used with the modified commode 100, it may be desirable to leave it running all of the time. This will ensure that even when no one is sitting on the modified toilet seat 104 or using the modified commode 100, that odors (i.e., vapors) that persist in the container 108 will be removed from the room in which the modified commode 100 is disposed.

It is also noted that a modified toilet seat cover (not shown) is typically used with the modified commode 100 and it is adapted to pivot as well about the axis and to cover the modified toilet seat 104 and hide the contents of the container 108 from view after waste matter has been deposited in the container 108.

When the modified toilet seat cover is disposed in a lower position (i.e., over the modified toilet seat 104), it provides a seal that helps to prevent vapors (i.e., odors) from leaving the area proximate the container 108 and entering into the room where the modified commode 100 is located.

If the remote motor 72 is used and if it is left running all of the time with the modified commode 100, then virtually no odors can escape or be detected and the modified commode 100 can be left proximate the user (and any visitors) without embarrassment.

Normally, a caregiver (not shown) will eventually remove the container 108, empty the contents of the container 108 into a conventional flush-type toilet, clean the container 108 of any residue fecal matter that may adhere to its sides, add more water thereto, and return it to the modified commode 100 for subsequent reuse.

Accordingly, the modified commode 100 provides for truly portable and independent use by the user. It may be placed proximate the user without causing excessive unpleasant odors.

The second vent hose 62 may be temporarily placed through an opening provided by partially opening a window (not shown) or a door (not shown), if preferred.

Figure 6:
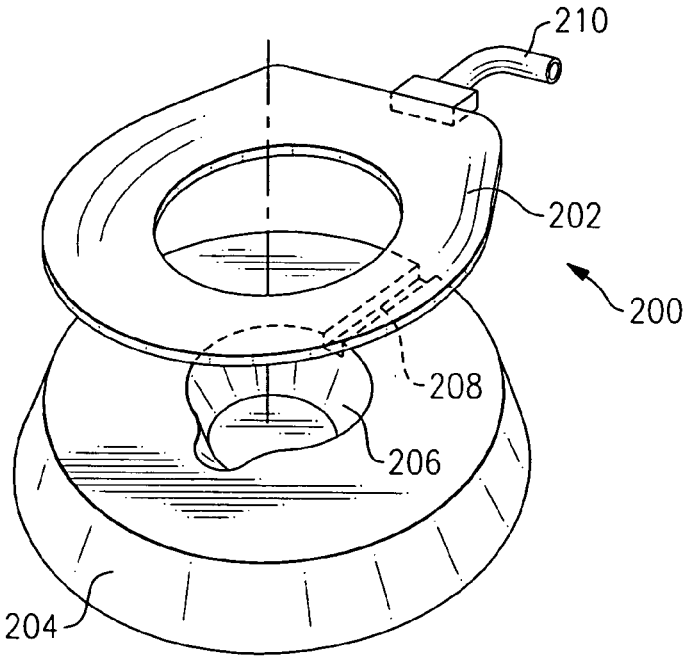
FIG. 6 is a view in perspective of a child's portable venting commode.

Referring now to FIG. 6, a child's portable venting commode 200 is shown in a partially exploded view with a child's seat 202 elevated above a base 204. A cup 206 collects waste matter and is removable.

A channel 208 conducts vapors to a rear fitting 210. The vent hose 34 (not shown in this view) is attached thereto as are the other component parts as are described hereinabove. Accordingly, it is shown that the instant invention is adaptable to any size as needed.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A portable venting commode, comprising:

(a) a portable commode frame structure, (b) a toilet seat attached to said portable commode frame structure; and (c) means for venting vapors to a distal location which is disposed outside of a room where said portable commode frame structure is disposed and wherein said means for venting includes a hose, having first and second ends and wherein the first end of said hose is attached to said portable commode frame structure and wherein the opposite second end of said hose is adapted to exhaust said vapors to said distal location; and wherein said means for venting vapors to a distal location, also includes one fan that is powered by a DC brushless motor and wherein said fan is attached to said hose at one location thereon selected from the first end of said hose; along the length between the first and second ends of said hose; at said second end of said hose and wherein said fan is adapted to generate a negative pressure in at least a portion of said flexible hose that is disposed intermediate said portable commode frame structure and said fan and wherein said fan has a discharge side for venting said vapors to said distal location.

2. The portable venting commode of claim 1 wherein said portable commode frame structure is adapted for placement over a conventional fixed-mount flush-type of toilet and a vent means is disposed at the second end of said hose to deliver said vapors to said distal location.

3. The portable venting commode of claim 2 including a chute attached to said toilet seat.

4. The portable venting commode of claim 3 wherein said chute includes an opening at a distal end with respect to an end where said chute is attached to said toilet seat, and wherein said chute is adapted to discharge human waste matter into said flush-type of toilet, and wherein said chute includes a portion thereof that is cylindrical in shape.

5. The portable venting commode of claim 3 wherein said chute includes an opening at a distal end with respect to an end where said chute is attached to said toilet seat, and wherein said chute is adapted to discharge human waste matter into said flush-type of toilet, and wherein said chute includes a portion thereof that is conical in shape.

6. The portable venting commode of claim 5 wherein said chute includes means for attaching a flexible hose thereto.

7. The portable venting commode of claim 5 including means for providing a seal intermediate said chute and a conventional type of a toilet seat that is attached to said flush-type of toilet, and wherein said chute is adapted for placement through an opening provided in said conventional type of a toilet seat.

8. The portable venting commode of claim 2 wherein said means for venting to said distal location includes a fan that is powered by a DC brushless motor and wherein said fan is attached to said frame structure.

9. The portable venting commode of claim 2 wherein said means for venting comprises a fan that is powered by a brushless DC motor and wherein said fan is attached distally with respect to said frame structure.

10. The portable venting commode of claim 1 wherein said flexible hose includes means for generating a positive pressure in at least a portion of said flexible hose that is disposed intermediate said fan and said portable commode frame structure.

11. The portable venting commode of claim 1 wherein said toilet seat includes an opening therein, wherein said opening is adapted for cooperating with said means for urging vapors.

12. The portable venting commode of claim 1 wherein said portable commode frame structure is adapted for stand-alone use.

13. The portable venting commode of claim 12 wherein said commode includes container means removably disposed under said means for providing a toilet seat.

14. The portable venting commode of claim 13 wherein said means for providing a toilet seat is adapted to pivot about an axis from a lower position into an upper position and wherein said container means is adapted for removal apart from said commode wherein said means for proving a toilet seat is disposed in said upper position.

15. The portable venting commode of claim 14 wherein said means for providing a seat includes means for providing a seal intermediate bottom of said means for providing a seat and said container means when said toilet seat is disposed in said lower position.

16. A portable venting commode, comprising:

(a) a portable commode frame structure;

(b) a toilet seat attached to said portable commode frame structure; and having an opening therein, and having sealing means on the bottom thereof;

(c) a removable container disposed on said frame beneath said seat and aligned therewith;

said sealing means taking up any space intermediate the bottom of said seat and the top of said container;

(d) means for venting vapors to a distal location outside of the room wherein said frame structure is disposed;

wherein said means for venting includes a flexible hose and a fan powered by a DC motor, said hose having a first end and a second end, wherein the first end is attached to said portable commode frame structure, and said fan is attached along said flexible hose, and is adapted to generate a negative pressure in at least a portion of said flexible hose;

(e) and venting means attached to said second end of said hose for venting vapors to a location outside of the room where the portable frame is disposed.

* * * * *